United States Patent [19]

Plath et al.

[11] Patent Number: 4,920,767

[45] Date of Patent: May 1, 1990

[54] ANNULAR KNITTING MACHINE WITH SLIDE NEEDLES

[75] Inventors: Ernst-Dieter Plath, Albstadt-Tailfingen; Kurt Juenthner, Bitz, both of Fed. Rep. of Germany

[73] Assignee: Sipra Patententwicklungs-und Beteiligungsges. dmbH, Albstadt/Tailfingen, Fed. Rep. of Germany

[21] Appl. No.: 223,602

[22] Filed: Jul. 25, 1988

[30] Foreign Application Priority Data

Jul. 25, 1987 [DE] Fed. Rep. of Germany ..... 3724732
Jun. 23, 1988 [DE] Fed. Rep. of Germany ..... 3821213

[51] Int. Cl.[5] ..... D04B 15/06; D04B 15/32

[52] U.S. Cl. ..... 66/13; 66/38; 66/54; 66/104

[58] Field of Search ..... 66/13, 38, 40, 42 R, 66/62, 104, 120, 54

[56] References Cited

U.S. PATENT DOCUMENTS 3,780,539 12/1973 Mishcon ..... 66/42 R
3,828,582 8/1974 Widdowson et al. ..... 66/13
4,608,839 9/1986 Tibbals, Jr. ..... 66/13
4,751,829 6/1988 Plath ..... 66/13

*Primary Examiner*—Wm. Carter Reynolds
*Attorney, Agent, or Firm*—Michael J. Striker

[57] ABSTRACT

A circular knitting machine has at least one needle carrier, and a plurality of slide needles having a head portion with a head and a slide portion with a tip. Sinkers cooperate with the slide needles, a plurality of knitting systems are arranged along the needle carrier, and a control is provided at the knitting systems for causing relative movements of the needle portions, the slide portions, and the sinkers for performing knitting, tacking and running-through operations. The control includes at each of the knitting systems a sinker cam curve for controlling the sinkers, a slide portion cam curve for controlling the slide portions, and a head portion cam curve for controlling the head portions. The slide portion cam curves have portions for raising and lowering the slide portions in a same manner irrespective of performance of knitting, tucking, or non-knitting operation of the systems.

12 Claims, 11 Drawing Sheets

ANNULAR KNITTING MACHINE WITH SLIDE NEEDLES

BACKGROUND OF THE INVENTION

The present invention relates to an annular knitting machine with at least one needle carrier with slide needles having controlled head and slide, with cam curves for controlling the needles for knitting, tucking or welting and with sinkers which cooperates with the slide needles and are controlled by a sinker cam curve.

Annular knitting machines with slide needles are known or proposed while by the exchange of a needle tongue by a controlled needle slide high needle displacement speeds can be obtained. In connection with this also a knitting machine is proposed in U.S. Pat. No. 4,751,829 in which the slide of the slide needles, which cooperates with sinkers, is held not displaceably on a constant height. It has been however shown that with a not controlled needle slide, certain limitations in the displacement width of the cam parts must be taken into consideration, when a high operational safety in each control position of the knitting tool must be guaranteed. However it is desired to utilize the slide needles in a circular knitting machine with needle selecting device for a needle position of knitting, tucking or welting, the latter sometimes also called floating, non-knitting, running through or circular motion. With the known control of the slide needles in which, without consideration of the proposal in the U.S. Pat. No. 4,751,829 the needle slide and the remaining needle is especially controlled by a means of a special control curve, a needle selecting device must also have the path for the needle slide changing points, which for a needle exchange device with a three-way technique involves a considerable expense. Also during the utilization of the so-called three-way technique with several cam paths, in which special cam paths for knitting, tucking and welting are provided and the needles are used for control feet directed to the individual cam paths, it is necessary with the known control technique of slide needles to provide for each of the three needle cam paths a respective slide cam curve. Thereby, great cam heights and corresponding great needle lengths and needle slide lengths are produced, and higher needle masses must be moved

SUMMARY OF THE INVENTION

Accordingly, it is an object of the present invention to provide a circular knitting machine which avoids the disadvantages of the prior art.

More particularly, it is an object of the present invention to provide a circular knitting machine with controllable slide needles which is formed so that it is not necessary to provide an increase of the mass of slide needles and the expense on control devices of a needle exchange device as well as the expense for cam parts, as compared with the known and comparable annular knitting machines, despite the fact that no limitation to the variation width of the known machines must take place.

In keeping with these objects and with others which will become apparent hereinafter, one feature of the present invention resides, briefly stated, in a circular knitting machine of the above mentioned general type in which for the slides of the slide needles for all needle cam curves, only one cam curve which cause longitudinal movement of the slide is provided.

In the annular knitting machine in accordance with the present invention no selecting devices or displacement devices for the needle slide must be provided, regardless of the fact whether a three-way technique in the event Jacquard needle selection or camming with one or several cam paths are used. In the annular knitting machine according to the present invention with slide needles the needles can be controlled with no limitation within a loop row in the needle positions of knitting, tucking or welting in accordance with a pattern The highest number of revolutions is obtained with knitting machines with one row of needles, in which the needles cooperate with sinkers. In accordance with this, the inventive approach is also developed for such machines. It has been shown that both for the case when during the thread sinking the slide needles perform a longitudinal movement and also for the case when the thread sinking is partially performed by a longitudinal movement of the needles and partially by a longitudinal displacement of combined jack or knock-over sinkers, the slide cam curve can have a shape to which all possible needle cam curves for knitting, tucking or welting can be adapted so that the respective needle function can be performed with no problem with higher machine speed. The needle slide curve is formed so that it raises with the delay relative to the needle curve for knitting, and raises relative to the needle curve for tucking simultaneously or with an offset.

When the circular knitting machine is designed in accordance with the present invention, the above described objects are completely achieved. The cam construction is not complicated, the size of the system, the slide needles and the needle support must not be increased relative to the known and comparable constructions. All needle positions are reachable with no limitation for extensive pattern possibilities.

The drawing illustrate the present invention with two examples, wherein the showing is limited to the inventive cam path to show by the control of the needle head and the needle slide the different needle functions, and for one example a radial partial portion of a circular knitting machine is presented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
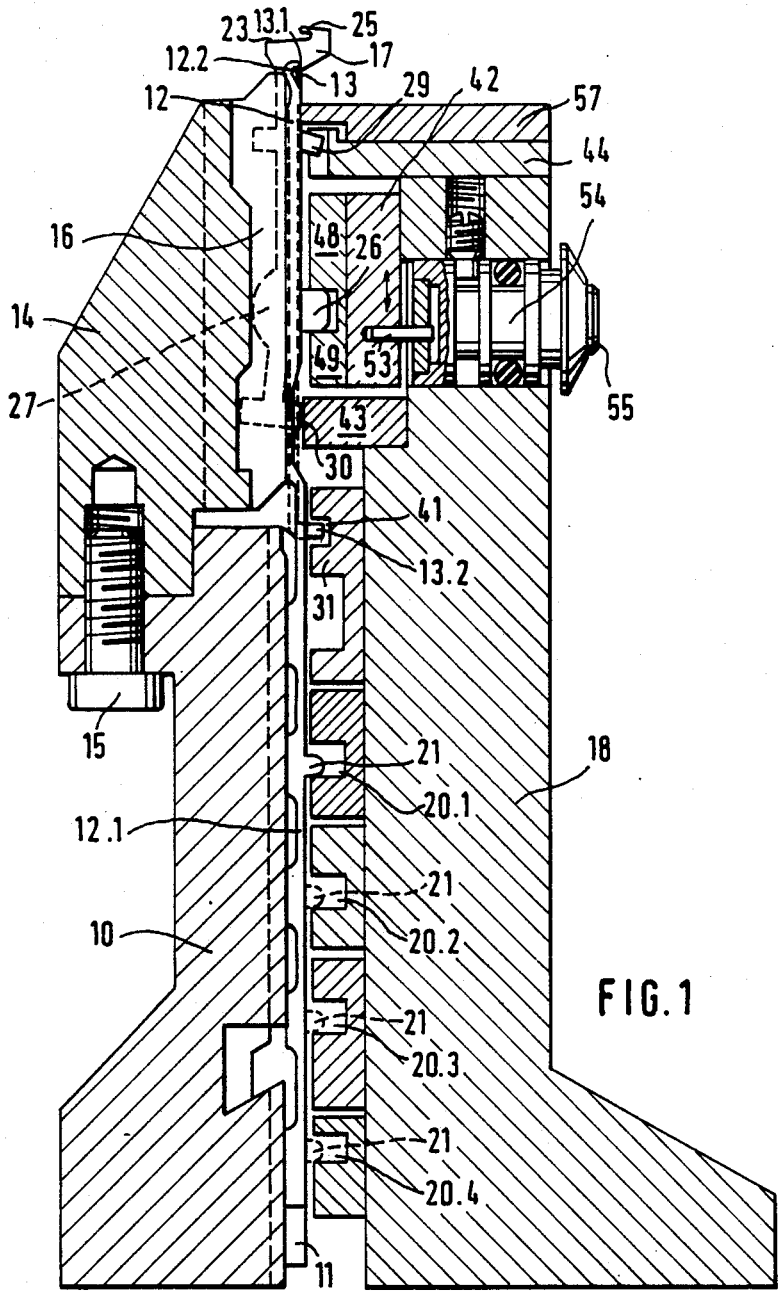
FIG. 1 is a view showing a radial section of an annular knitting machine provided with slide needles and sinkers which are controlled in accordance with the embodiment of FIGS. 9–14.

An annular knitting machine shown in FIG. 1 has a rotatable cylindrical knitting tool carrier 10/14 which is subdivided into a needle cylinder part 10 and a sinker cylinder part 14. Both parts are firmly connected with one another by screws 15.

An outer surface of the needle cylinder part 10 is provided in a known manner with axis-parallel guide webs 11 which accommodate therebetween shafts 12.1 of slide needles 12. The sinker cylinder part 14 is arranged coaxially with the needle cylinder part 10 and is provided with axis-parallel guiding webs 16 for accommodating therebetween jack or knock-over sinker 17 which will be called sinkers hereinbelow. The sinkers 17 are arranged in a longitudinally displaceable and turnable manner. The guiding web 16 for the sinkers 17 in the sinker cylinder part 14 are arranged with the same distance as the guiding webs 11 of the needle cylinder part 10. However, they form gaps with the guiding webs 11 of the needle cylinder part 10. The needle shafts 12.1 slide with their needle rear sides against the end side of the sinker guiding webs 16. The needle cylinder part 10 and the axial sinker cylinder part 14 are surrounded by a common cam housing 18 which is provided in a known manner with cam parts for controlling the slide needles 12, the needle slide 13, and the sinkers 17. A holding-down member 57 acts upon the needle shaft 12.1 under a head 12.2 of the slide needles 12.

The needle slide 13 which serves for closing the needle heads 12.2 is formed so that its tip 13.1 can pass the needle head 12.2. It extends with its foot 13.2 into a slide cam path 41 of the cam housing 18. The details of the construction of the slide needles 12 and the support for the slide 13 in the needle shaft 12.1 is not germaine to the present invention and therefore is not shown in detail.

The slide needles 12 are provided with a control foot 21 in the region of the needle shaft 12.1 between the guide webs 11 on the needle cylinder part 10. The control foot 21 can be located on one of four possible locations which have a different distance from the needle head 12.2 and extends in one of several needle cam paths 20.1–20.4 formed in the cam housing 18, as can be seen from FIG. 2.

The sinkers 17 which are shown in FIG. 1 are formed as jack or knock-over sinkers with a head part which is characteristic for this type of sinkers. The head part has a knock-over edge 23 which merges at its end in a jack or clear throat 25 for clearing the loops. The longitudinal displacement of the sinkers 17 is activated on a central control foot 26, at which height the sinker is supported with a rounded projection 27 against the sinker cylinder part 14. The turning movement of the sinkers 17 about the projection 27 is controlled through pressure feet 29 and 30 which are located on opposite sides of the control foot 26 on a relatively short sinker shaft.

In the shown annular knitting machine a loop length change is performed by an adjustment of the displacement path of the jack or knock-over sinkers 17. For this purpose cam parts 48 and 49 which act on the control foot 26 of the sinkers 17 are mounted on a displaceable cam plate 42. The cam plate 42 is coupled through an eccentric shaft 53 with an outwardly extending adjusting shaft 54 which ends in an outer adjusting disc 55. The sinking path of the sinkers 17 can be adjusted by the adjusting disc 55.

Figure 2:
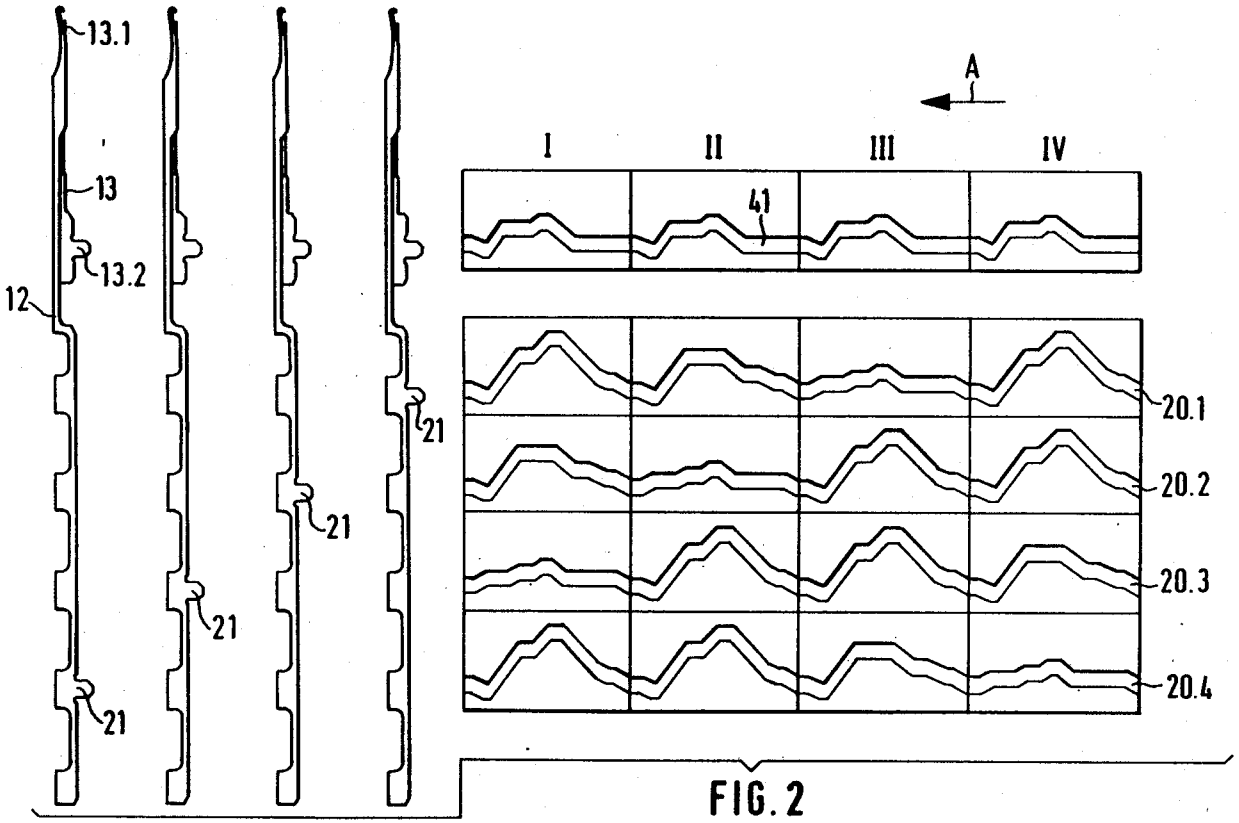
FIG. 2 is a view showing four cam passages for the needles and a cam passage for the needle slide, or four systems, together with the slide needles associated with the four needle cam paths.

FIG. 2 shows in its left part four slide needles 12 which are provided for cooperating with known horizontally supported jack (clearing) sinkers and thereby have somewhat different dimensions that the slide needle 12 in FIG. 1. The four slide needles 12 shown in FIG. 2 differ only in a different arrangement of their control foot 21. The control feet 21 are directed to four needle cam paths 20.1, 20.2, 20.3, or 30.2 shown in the right part of FIG. 2. They are represented by four systems I–IV of the annular knitting machine. The four needle cam paths 20.1–20.4 have a different course in correspondence with the three-way technique achieved by them for needle control in the sequentially arranged systems. In contrast, the upper slide cam curve 41 for the control foot 13.2 of the needle slide 13 has in each system the exactly identical course.

The slide needles 12 which extend with their control foot 21 into the uppermost needle cam path 20.1 are driven in the system I up to the knitting position, in the system II only up to the tucking position, they remain in the system III in the welting position, and again driven in the system IV up to the knitting position. The slide needles 12 which extend with their control foot 21 into the needle cam path 20.2 are driven in the system I up to the tucking position, remain in the system II in the welting position, and in the subsequent systems III and IV are driven up to the knitting position. With the aid of the four needle paths, a texture pattern is produced with a pattern width having four loops. The height of the pattern is dependent upon the number of systems of the annular knitting machine. For allowing the slide cam path 41 to be maintained always with the same course for each type of the needle cam path, its course for knitting, tucking and welting motion, the cam paths must have a course which is determined relative to one another and is not shown in FIG. 2 but instead can be seen from subsequent FIGS. 3–14. Also, a Jacquard pattern is possible with individual needle selection by known mechanic or electronic pattern devices or selecting devices.

Figure 3:
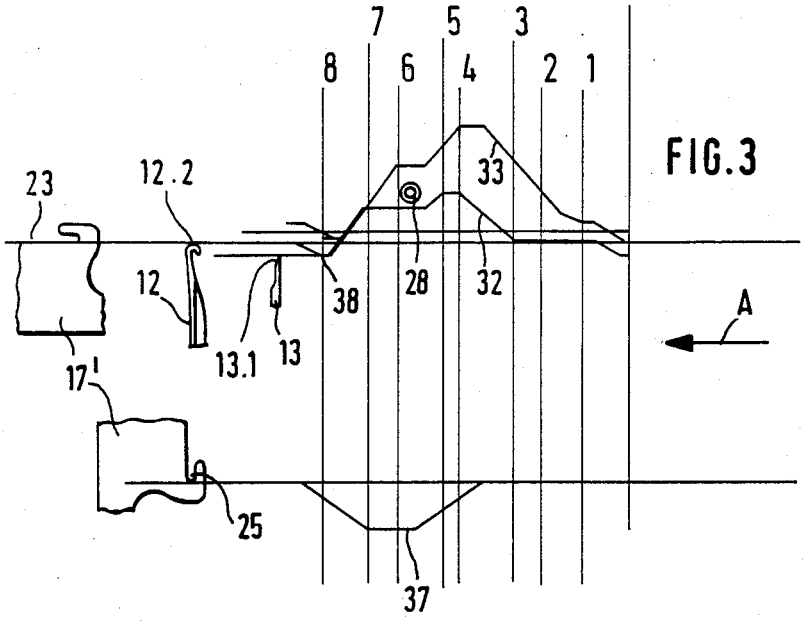
FIG. 3 is a view showing the slide cam path, the needle cam path for knitting and the sinker cam path, over one system when the sinkers are provided for only moving radially with respect to the needle cylinder.
Figure 5:
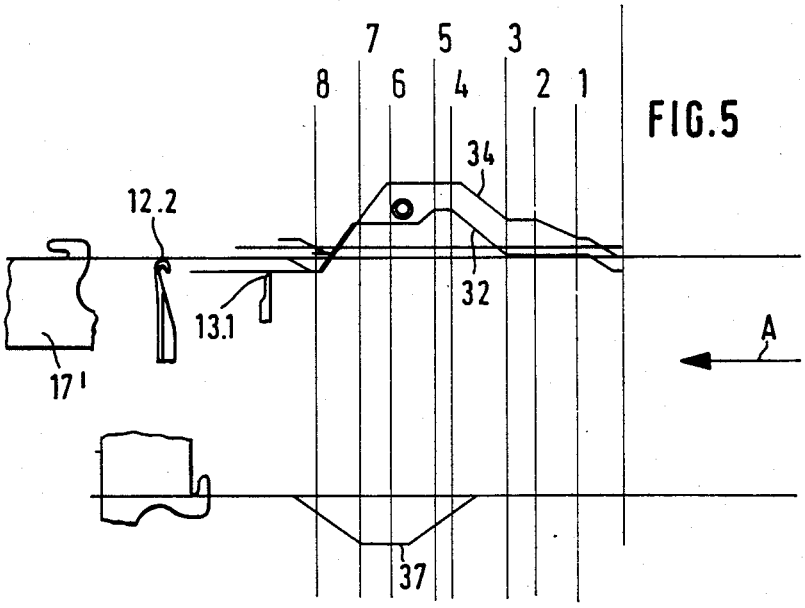
FIGS. 5 and 6 are views showing the positions corresponding to FIGS. 3 and 4 with the needle cam path for tucking.
Figure 4:
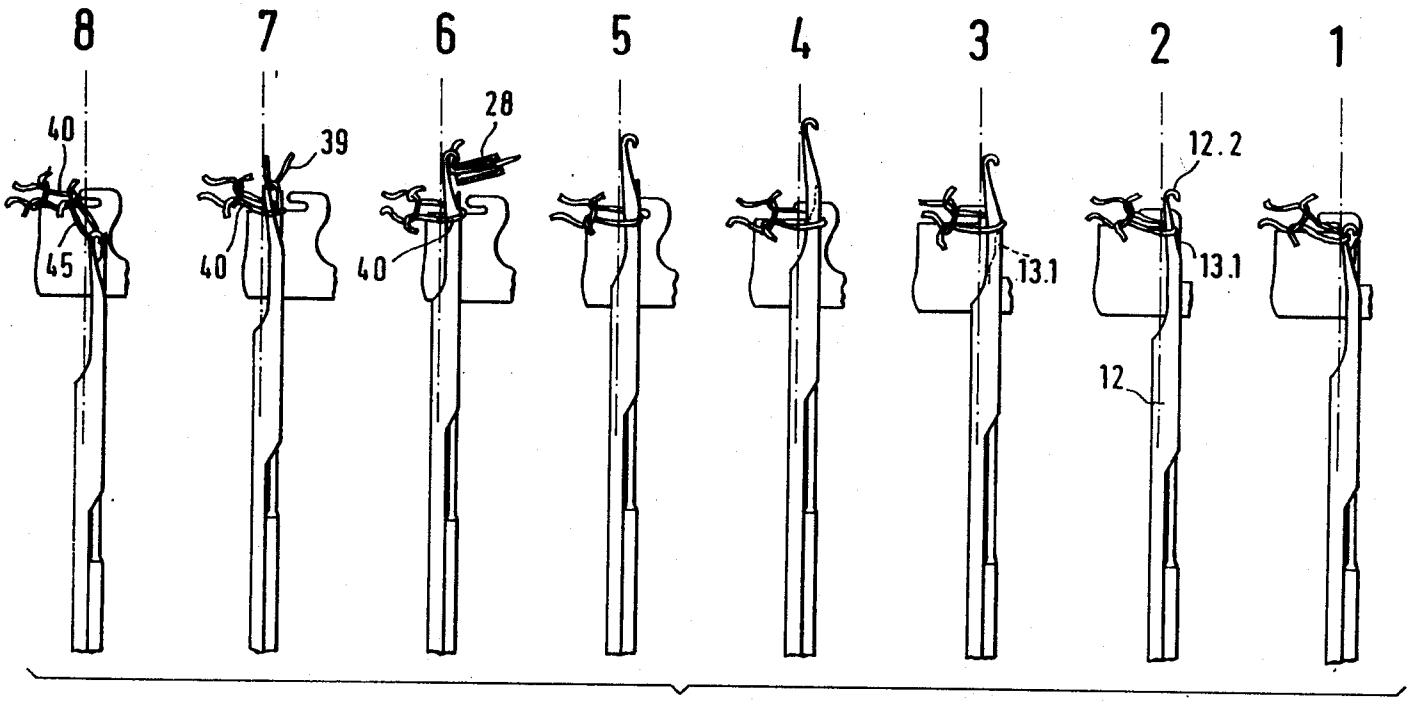
FIG. 4 shows eight relative positions of the slide needles and sinkers on points 1–8 of FIG. 3.
Figure 6:
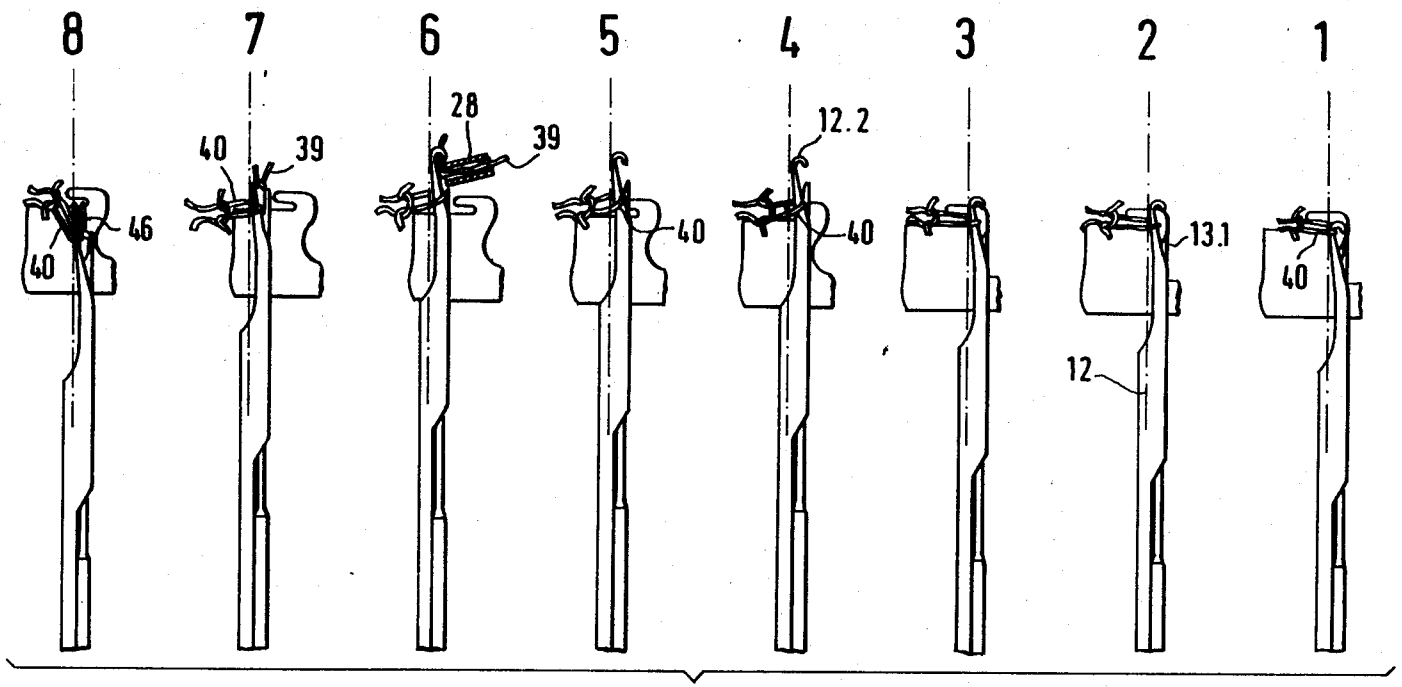
Figure 7:
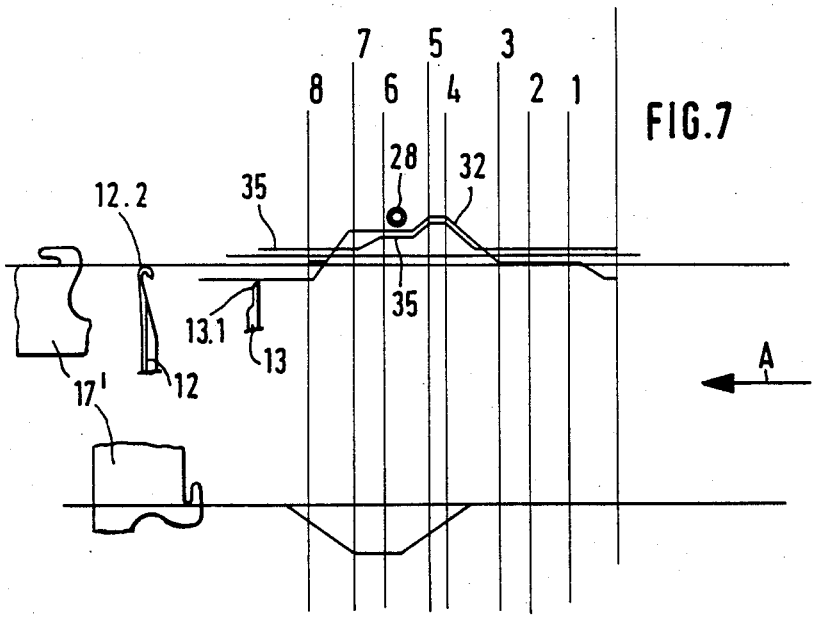
FIGS. 7 and 8 are views showing the position corresponding to FIGS. 3 and 4 with the needle cam path for welting.
Figure 8:
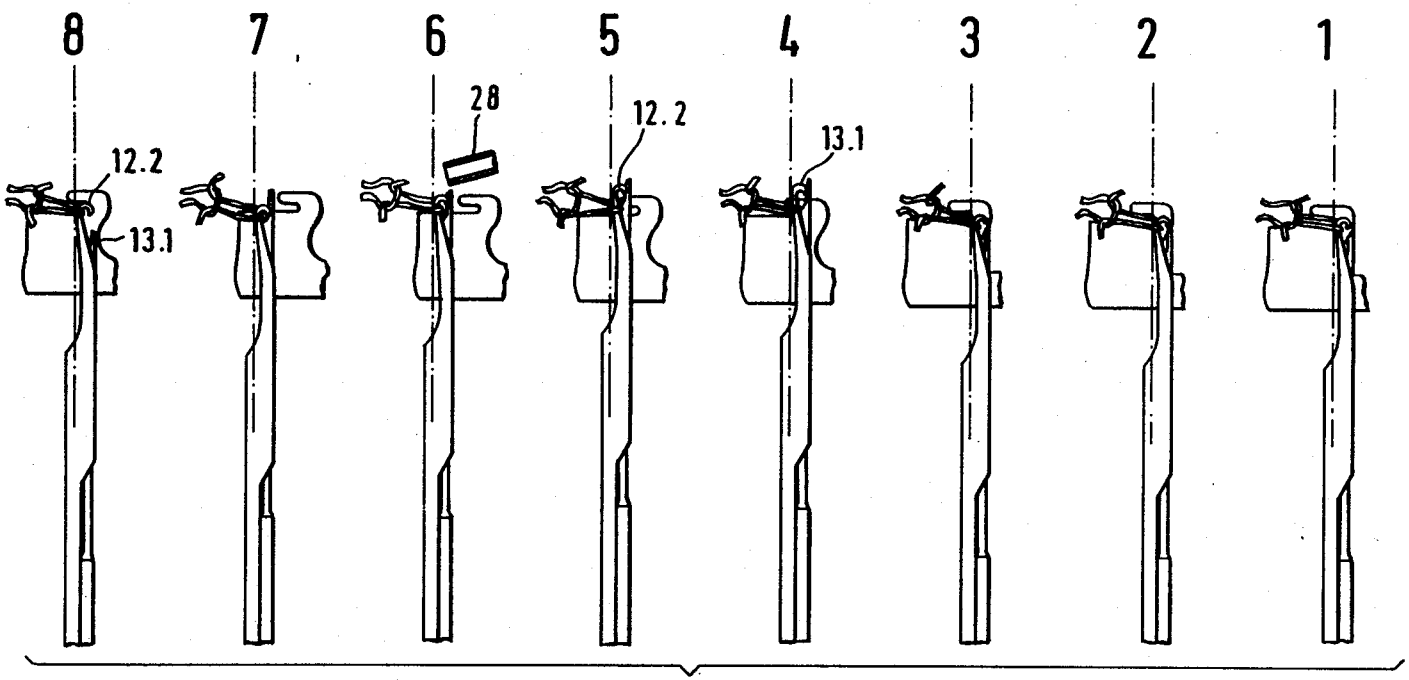

FIGS. 3, 5 and 7 show for a circular knitting machine with slide needles and horizontally displaceble sinkers extending transversely to the longitudinal direction of the needles, the movement curve for the needle slide tip, the movement curves of the needle head for the possible needle positions of knitting, tucking and welting and additionally the curve of the sinker movement. Moreover, FIGS. 4, 6 and 8 show the relative position of the needle shaft and the needle slide at eight points 1–8 identified in FIGS. 3, 5 and 7.

The arrow A identifies in FIGS. 3, 5, 7, 9, 11, 13 the needle passage direction through the system and a thread supply point 28 is identified by a schematically shown thread guide. In FIGS. 3–8 the known sinkers which in deviation from FIG. 1 can also be supported in a special sinker ring, are identified with reference numeral 17'.

FIG. 3 shows a needle slide cam curve 32 which follows the needle slide tip 13.1 and the curve 33 which follows the needle head 12.2 in the needle position of knitting. In addition, a curve 37 follows the jack throat 25 of the sinkers 17'. The needle slide cam curve 32 shows that during passage of one system the slide tip 13.1 first is lifted prior to the position 1 to a height which corresponds to the welting height of the needle head 12.2 and the height of the knock-over edge 23 of the sinker 17'. On this height the slide tip 13' remains until the point 3. Subsequently, between points 3 and 4, the needle slide tip 13.1 is driven up to approximately the height of the thread supply point 28 from the point 5, thereby before reaching the thread supply point 28, but is again lowered below the thread supply height and subsequently to the point 7 to a height which lies above the loop knock-over height. Between, the points 7 and 8, the needle slide tip 13.1 is drawn to the thread knock-over height identified on the position 8 in FIG. 3 with 38, so as to coincide with the curve 33 for the needle head 12.2. The curve 33 for the position of knitting shows that the needle head 12.2 is already driven from the point 1 and thereby substantially earlier than the needle slide 13, until it reaches the knitting position between the points 3 and 4. As the associated FIG. 4 shows, by the earlier drive of the needle head 12.2 the slide tip 13.1 disappears from the point 2 in the shaft of the slide needle 12 and releases the needle head 12.2. By the substantially parallel course of curves 32 and 33 between the points 4 and 6, the needle head 12.2 remains open also over the thread supply point 28. Since the needle slide 13 during the drawing movement of the needle head 12.2 between the points 6 and 7 remains unchanged, the old loop 40 remains on the needle slide 13 and it clears the needle head up to the point 17 and clears the newly supplied thread 39. During the further drawing movement of the needle head 12.2 between the points 7 and 8, when the needle slide cam curve 32 of the needle slide tip 13.1 runs in coincidence with the curve 33, the needle head remains closed, so that the old loop 40 can pass over the closed needle head while a new loop 45 is drawn.

FIG. 5 shows in addition to the needle slide cam curve 32 for the needle slide tip 13.1, the curve 34 which the needle head 12.2 passes for the position tucking. A comparison with FIG. 3 shows that here the drive out of the needle head 12.2 is performed substantially later than in the position of knitting. The drive out proper of the needle head 12.2 in the tucking position assumed between the points 4 and 6 starts first at the point 3. FIG. 6 shows that between the points 2 and 5 the slide tip 13.1 does not disappear as in the knitting position in the needle shaft, but instead projects out of the needle shaft and the needle head 12.2 is open only in half. This means that an old loop 4 which is available in the needle head cannot slide out of the needle head. By the lowering of the needle slide tip 13.1 between the points 5 and 6 under the thread supply height, it is guaranteed that the new thread 39 can be inserted on the point 6 reliably in the needle head 12.2, prior to closing of the needle head by the needle slide between the points 6 and 7, and for old loop 40 a new tucking hook 46 is formed during the remaining drawing movement up to the point 8.

FIG. 7 shows the conditions for the needle position of welting. In FIG. 7 in addition to the needle slide cam curve 32 for the needle slide tip 13.1, a curve 35 is shown which follows the needle head 12.2. The curve 35 substantially follows the needle slide cam curve 32 so that the needle head 12.2 is particularly always closed by the needle slide 13, as shown in FIG. 8. The slide tip 13.1 projects between the points 4 to 7 over the needle head 12.2. At the point 8, the needle head 12.2 is again released in half by the slide tip 13.1. By the lowering of the curve 35 relative to the needle slide cam curve 32 for the needle slide between the points 6 and 7, the needle head does not prevent the insertion of the thread in a preceding needle. The needle slide cam curve 32 for the slide tip 13.1 does not lower very far. Therefore, it is insured that in the operation of knitting the old loop 40 located between the points 6 and 7 on the slide 13 (see FIG. 4) cannot fall again back into the needle head 12.2.

Figure 9:
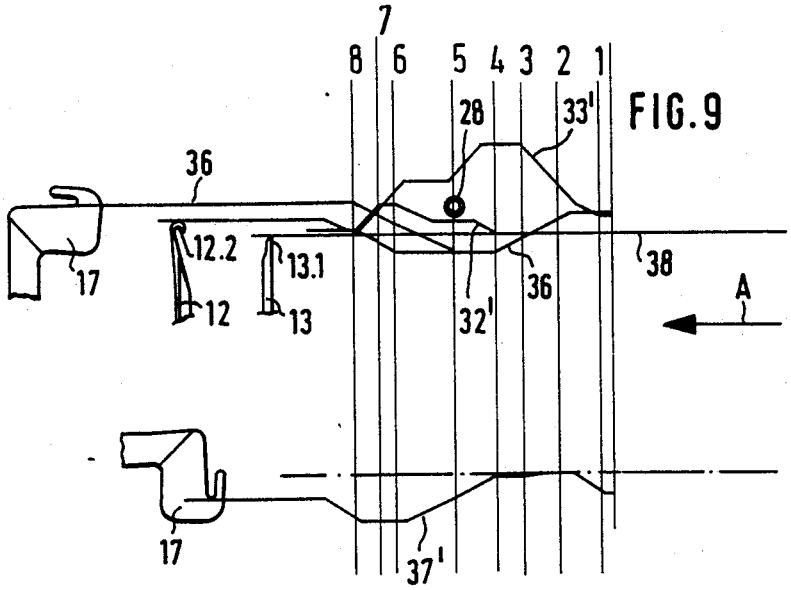
FIGS. 9 and 10 are views corresponding to FIGS. 3 and 4 with the needle cam path for knitting, in an example in which jack or knock-over sinkers are provided and move longitudinally in certain regions in opposite direction to the slide needles.
Figure 10:
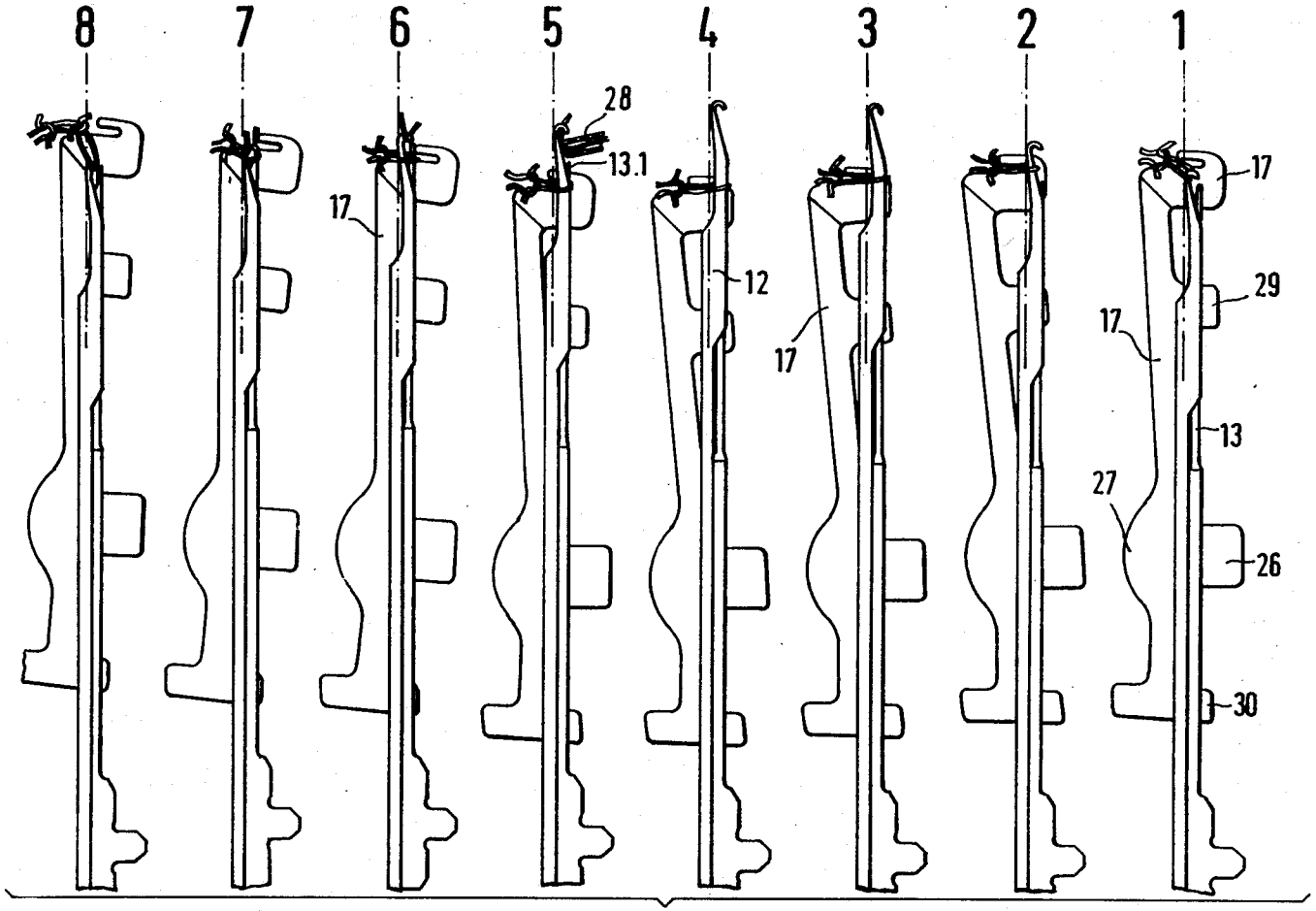
Figure 11:
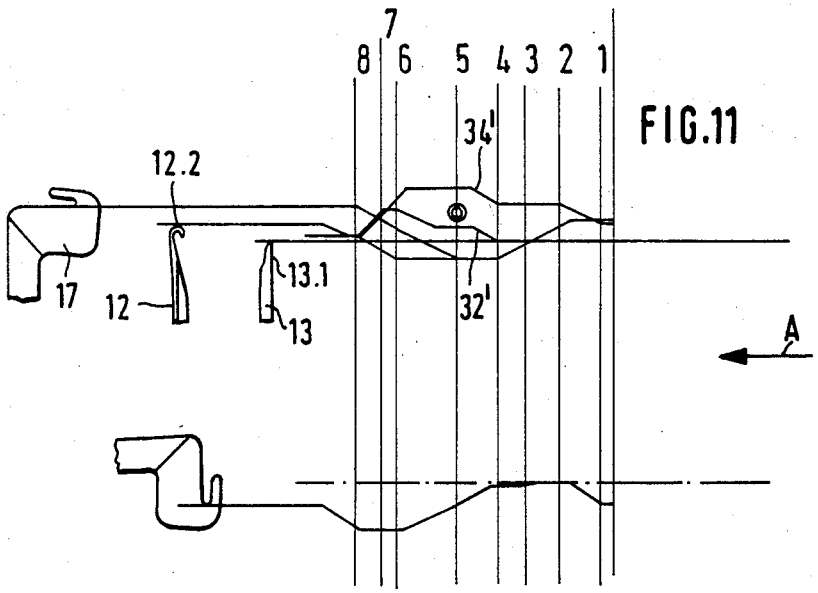
FIGS. 11 and 12 are views corresponding to FIGS. 9 and 10 with the needle cam curve for tucking.
Figure 13:
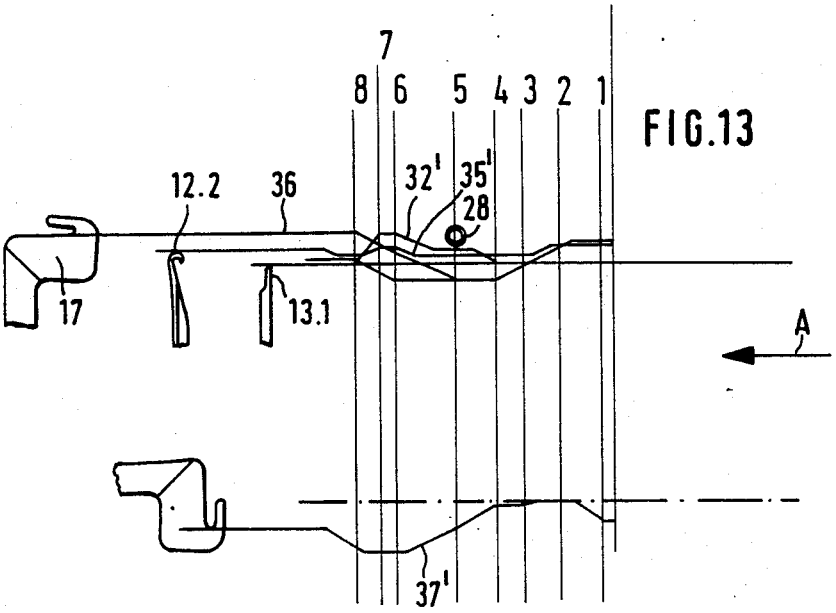
FIGS. 13 and 14 are views corresponding to FIGS. 9 and 10 with the needle cam curve for welting.

FIGS. 9–14 show the profile and the relative course of the curve slide needles which cooperate in the embodiment shown in FIG. 1 with the sinkers 17 which are adjustable in correspondence with a curve 36 shown in FIGS. 9, 11 and 13 in the longitudinal direction of the slide needle. A needle slide cam curve 32' for the needle slide tip 13.1 which is shown in FIGS. 9, 11, 13 has the same course for all needle positions of knitting, tucking and welting, however this course is different from the course of needle slide cam curve 32 in FIGS. 3, 5, 7. During passage of one system the needle slide cam curve 32' of the slide tip 13.1 remain first over at least one-third of the system length, here up to the point 4, in deepest drawn position which corresponds to the height 38. Prior to the thread supply point 28, the slide tip 13.1 is driven out to a height located under the thread supply height, in which it remains held over the thread insertion point 5, and first after the thread supply point 28 is driven together with the sinker 17 to the height at the points 6 and 7 in FIGS. 10, 12 and 14. Finally, the needle tip 13.1 is further drawn in coincidence with the sinking portion of the curve for the needle head 12.2, to the deepest drawn position 38.

FIG. 9 shows the needle slide cam curve 32' for the needle slide tip 13.1 together with a curve 33' which follows the needle head 12.2 in the position of knitting. The relative position of the slide needle 12, needle slide 13 with the needle slide tip 13.1 and the jack-knock-over sinkers 17 produced by the course of the needle slide cam curve 32', 33' and the curves 36, and 37' for the sinkers 17, on the points 1–8 is shown in FIG. 10. Similar to FIGS. 3 and 4, the needle head 12.2 is already raised from the point 2 and thereby substantially earlier than the needle slide 13, until it reaches the knitting position between the points 3 and 4. FIG. 10 shows position between the points 3 and 4. FIG. 10 shows that the slide tip 13.1 disappears from the point 2 in the shaft of the slide needle 12 and releases the needle head 12.2. By the course of curves 32 and 33 between the points 4 and 6 as shown in FIG. 9, the needle head 12.2 remains open also over the thread supply point 28, even if the slide tip 13 extends somewhat into the needle head 12.2. At point 6 the head 12.2 is completely closed. Since the needle slide 13 during the lowering movement of the needle head 12.2 between the points 6 and 7 remains unchanged, the old loop 40 remains on the needle slide 13. During the further drawing-down movement of the needle head 12.2 between the points 7 and 8, when the needle slide cam curve 32 of the needle slide tip 13.1 runs in coincidence with the curve 33, the needle head remains closed, so that the old loop can pass over the closed needle head with a new loop is drawn.

Figure 12:
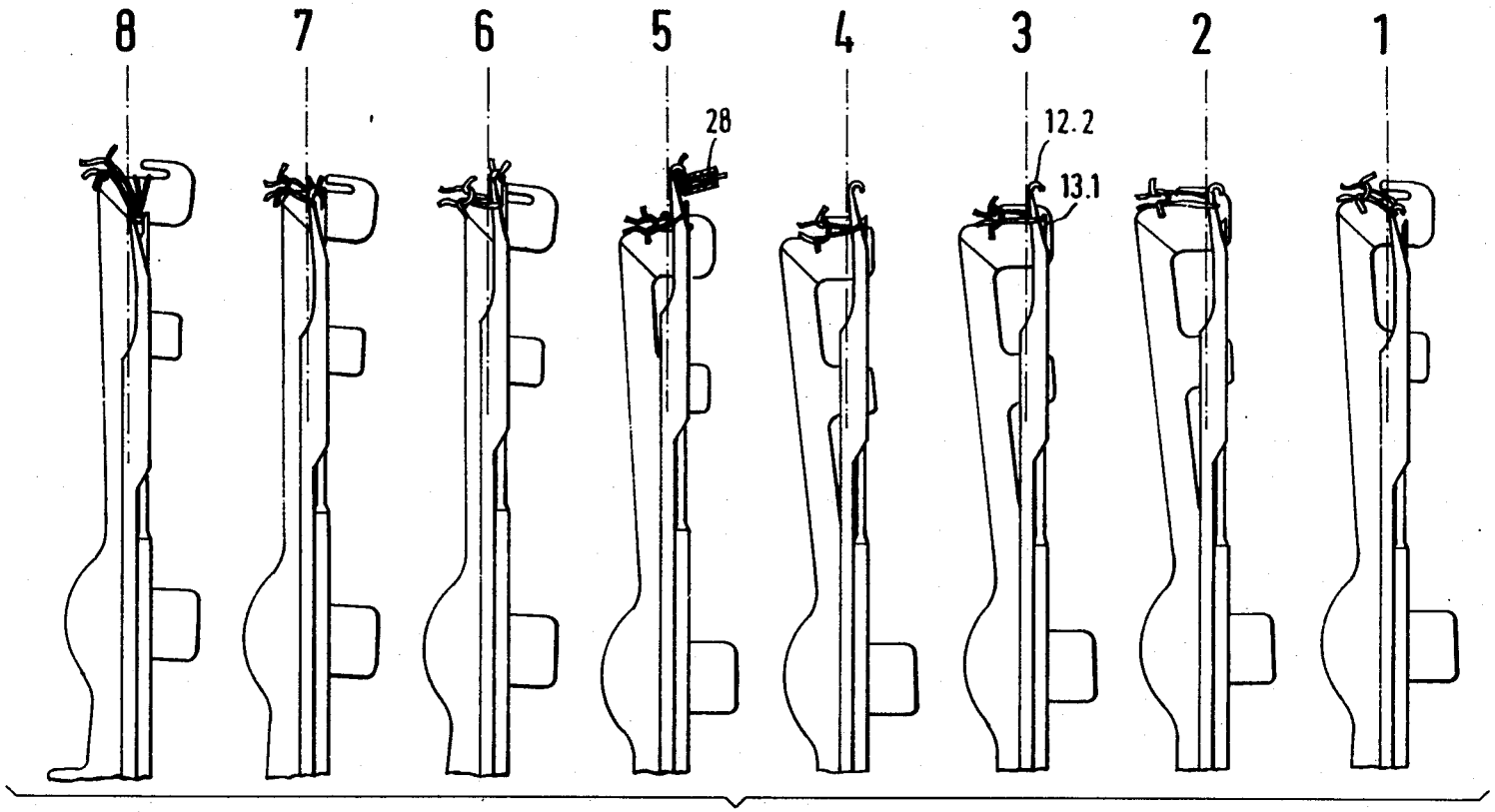

FIG. 11 shows the needle slide cam curve 32' for the needle slide tip 13.1 together with a curve 34' which follows the needle head 12.2 in the needle position of tucking. Here also the comparison of FIGS. 9 and 11 shows that the needle drive out for the position of tucking is performed later than for the position of knitting, and thereby in accordance with FIG. 12 for the position of tucking it is insured that the slide tip 13.1 of the needle head is never completely open, but always projects out of the needle shaft. FIG. 12 further shows the relative position of individual moveable parts at the points 1–8 of the system. FIG. 11 shows in addition to the needle slide cam curve 32 for the needle slide tip 13.1 the curve 34 which the needle head 12.2 passes for the operation tucking. A comparison with FIG. 9 shows that here the raising of the needle head 12.2 is performed substantially later than in the operation knitting. The raising of the needle head 12.2 in the tucking operation starts first at the point 4. FIG. 12 shows that between the points 1 and 4 the slide tip 13.1 does not disappear in the needle shaft, but instead projects out of the needle shaft and the needle head 12.2 is open only in half. This means that an old loop which is available in the needle head cannot slide out of the needle head. By the guiding of the needle slide tip 13.1 between the points 4 and 5 under the thread supply height, it is guaranteed that the new thread can be inserted at the point 5 reliably in the needle head 12.2, prior to closing of the needle head by the needle slide between the points 5 and 6. Additionally to the old loop a new tucking hook is formed during the remaining drawing-down movement up to the point 8.

Figure 14:
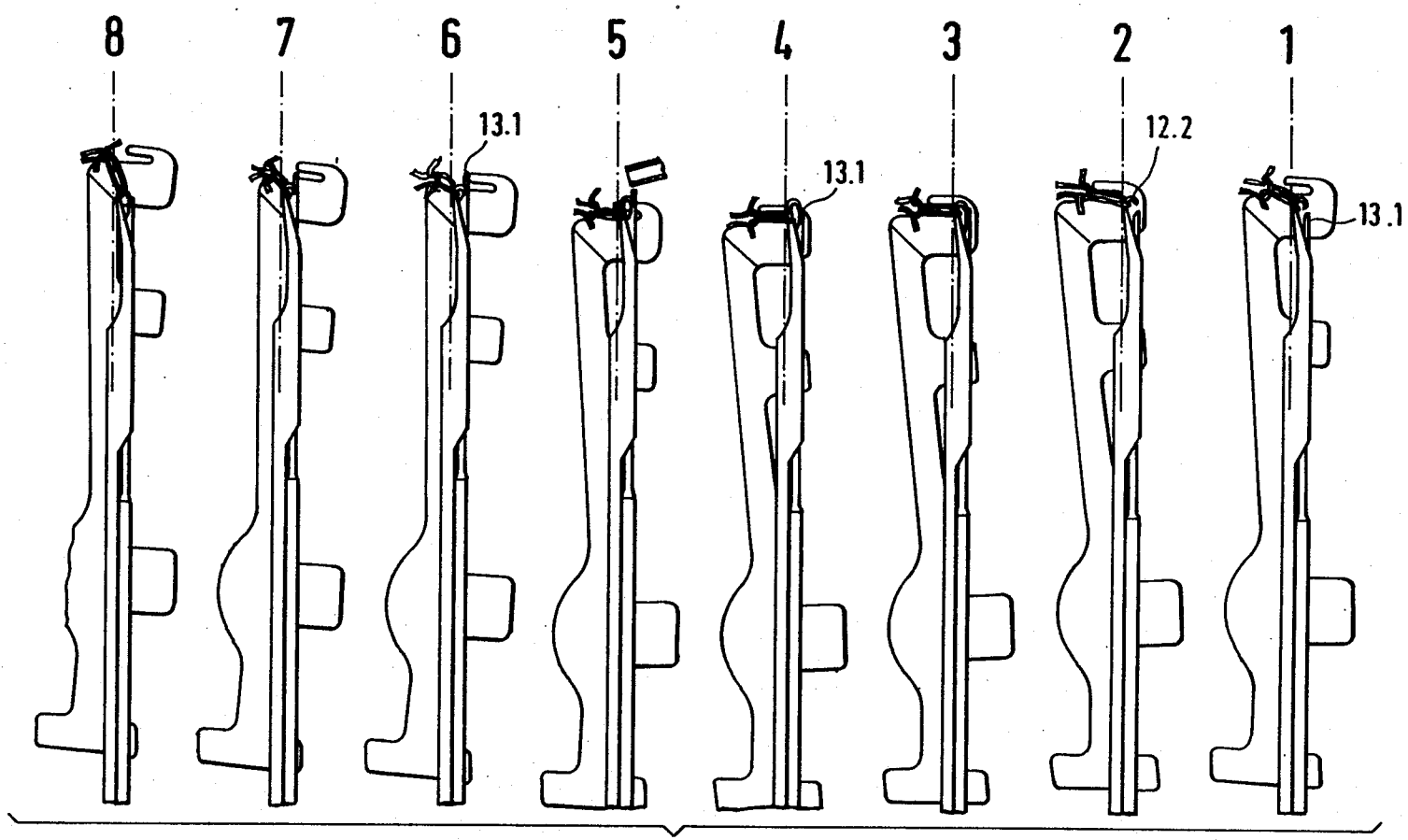

FIGS. 13 and 14 show the condition for the needle position of welting. FIG. 13 shows in addition to the needle slide cam curve 32', also a curve 35' which follows the needle head 12.2 and which is substantially parallel to the slide cam curve 32. Between the points 1 and 2, the needle head 12.2 is driven out relative to the needle slide tip 13.1 so far that the needle head 12.2 is not completely closed. FIG. 14 shows however that on the other points 3–8 the needle head is always closed by the needle slide tip 13.1 which moves outwardly over the needle head.

The movement of the sinkers 17 are always the same during the operations knitting, tucking and welting as shown in FIGS. 9–14. A cam curve in the lower part of FIG. 9, 11 and 13 substantially corresponds to cam curve 37 of FIG. 3. Contrary thereto, cam curve 36 of FIG. 9, 11 and 13 shows the movements of the sinkers 17 parallel but substantially opposite to the movements of the needle heads 12.2. As is particularly depicted in FIGS. 10, 12 and 14, the sinkers 17 are first lowered to some extent between points 1 and 4 and then again raised between points 5 and 8. By this, the sinkers 17 move in a direction opposite to that of the slide needles particularly between points 6 and 9 for assisting in a known manner the forming of the loops (U.S. Pat. No. 4,751,829).

The invention is not limited to the sinker guide and sinker support shown in FIG. 1. The invention can also be used on machines with horizontal sinkers supported in a special sinker ring.

It will be understood that each of the elements described above, or two or more together, may also find a useful application in other types of constructions differing from the types described above.

While the invention has been illustrated and described as embodied in a circular knitting machine with slide needles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A circular knitting machine comprising at least one needle carrier; a plurality of slide needles, each slide needle having a head portion with a head and a slide portion with a tip; a plurality of sinkers cooperating with said slide needles; a plurality of knitting systems along said needle carrier; and control means at said knitting systems for causing relative movements of said needle portions, said slide portions, and said sinkers such that knitting, tucking and welting operations are performed, said control means including at each of said knitting systems a sinker cam curve for controlling said sinkers, a slide portion cam curve for controlling said slide portions, and a head portion cam curve for controlling said head portions, said slide portion cam curve having portions for raising and lowering said slide portions in a same manner irrespective of performance of knitting, tucking, or welting operation at each of said systems, said head portion cam curve having different types of courses, a first one of said types of courses causing movements of said head portions for providing said knitting operations, a second one of said type of courses causing movement of said head portions for providing said tucking operations, and a third one of said types of courses causing movements of said head portions for providing said welting operations.

2. A circular knitting machine according to claim 1, wherein said slide portion cam curve portions are formed so that, during passage of a system, said tips of said slide portions are at least first held at a lowermost height, are then raised at least to a higher under a thread supply height before reaching a thread supply location, are then held at this height for passing said location, and finally are again lowered to said lowermost height.

3. A circular knitting machine according to claim 1, wherein said slide portion cam curve portions are formed so that, during passage of a system, said tips are first raised from a lowermost height to a height which corresponds to a needle head welting height, are then held at this height, subsequently are raised to a thread supply height, are then lowered under said thread supply height to a height above a loop knock-over height before reaching a thread supply location, are then held at this height to pass said location and finally are lowered to said lowermost height.

4. A circular knitting machine according to claim 1, wherein said slide portion cam curve portions are formed so that, during passage of a system, said tips are first held at a lowermost height, are then raised to a height under a thread supply height for passing a thread supply location, are then further raised, and finally are again lowered to said lowermost height.

5. A circular knitting machine according to claim 2, wherein a head portion cam curve course according to said first type of said courses is formed so that said needle head portions are raised to a knitting position, and are raised to said knitting position with respect to said slide portions in such a way that said tips disappear in said head portions for opening said heads.

6. A circular knitting machine according to claim 5, wherein said head portion cam curve course according to said first type of said courses is formed so that said needle heads after having reached said knitting position, are moved with respect to said slide portions such that they pass said thread supply location with said heads remaining open, and are then lowered with respect to said slide portions to close said heads by said tips, and finally are lowered together with said slide portions such that loops held on said head portions can pass over said closed heads.

7. A circular knitting machine according to claim 2, wherein a head portion cam curve course according to said second type of said courses is formed so that said needle portions are raised with respect to said slide portions in such a way that said heads reach a tucking position, said tips extend into an opening of said heads and that said heads are only open in an upper half such that loops being held in said heads can not slide out of said heads.

8. A circular knitting machine according to claim 7, wherein said head portion cam curve courses according to said second type of said courses are formed so that said head portions after having reached said tucking position, are moved with respect to said slide portions such that a thread may be inserted into said heads at said thread supply location, and are then lowered with respect to said slide portions to close said heads with said tips and to form tuck stitches.

9. A circular knitting machine according to claim 2, wherein said head portion cam curve courses according to said third type of said courses are formed so that said heads of said head portions substantially remain closed by said tips during passage of a system.

10. A circular knitting machine according to claim 1, wherein said sinkers are longitudinally displacable and turnable and their knock-over edges during a lowering movement of associated slide needles are at least partially longitudinally movable in an opposite direction, and wherein, during a passage of a system, said tips of said slide portions remain first over at least a third of a system length at a lowermost position, then, prior to a thread supply location, are raised together with said head portions which are raised to a tucking position to a height under a thread supply height, then, after passing said thread supply location, are further raised together with said sinkers, and finally are lowered in correspondence with lowering portions of said needle portion cam curve portions.

11. A circular knitting machine according to claim 1, wherein said head portions are so formed that tips can pass beyond said heads.

12. A circular knitting machine according to claim 1, further comprising loop length changing means having means for adjusting said sinker cam curve.

* * * * *